US008246521B2

(12) United States Patent
Alexander et al.

(10) Patent No.: US 8,246,521 B2
(45) Date of Patent: Aug. 21, 2012

(54) PLYOMETRIC JUMPING EXERCISE GAME APPARATUS AND METHOD OF USE

(75) Inventors: Mark Alexander, Paradise, UT (US); Jerry K. Leipheimer, Sharpsville, PA (US); John M. Salvitti, Venetia, PA (US)

(73) Assignee: John M. Salvitti, Venetia, PA (US)

( * ) Notice: Subject to any disclaimer, the term of this patent is extended or adjusted under 35 U.S.C. 154(b) by 0 days.

(21) Appl. No.: 12/578,217

(22) Filed: Oct. 13, 2009

(65) Prior Publication Data

US 2010/0120587 A1 May 13, 2010

Related U.S. Application Data

(60) Provisional application No. 61/104,759, filed on Oct. 12, 2008.

(51) Int. Cl.
*A63B 71/00* (2006.01)

(52) U.S. Cl. ..... 482/8; 482/51; 482/142

(58) Field of Classification Search ..... 482/1–9, 482/15, 51–52, 77, 81, 83–84, 142, 146, 482/148; 434/250; 463/7; 273/440, 449, 273/450

See application file for complete search history.

(56) References Cited

U.S. PATENT DOCUMENTS 2,893,734 A * 7/1959 Tarte, Jr. ..... 273/317.3
3,865,367 A * 2/1975 Breslow et al. ..... 273/432
3,922,944 A * 12/1975 Kurosaki et al. ..... 84/721
4,013,292 A * 3/1977 Cohen et al. ..... 273/371
4,121,488 A * 10/1978 Akiyama ..... 84/720
4,304,404 A * 12/1981 Pundt ..... 463/4
4,720,789 A * 1/1988 Hector et al. ..... 463/33
4,730,826 A 3/1988 Sudmeier
4,813,665 A * 3/1989 Carr ..... 482/3
4,836,546 A * 6/1989 DiRe et al. ..... 463/18
D313,238 S 12/1990 Saraceni
5,033,745 A * 7/1991 Sullivan et al. ..... 473/184
5,397,260 A * 3/1995 Tilbor et al. ..... 446/4
5,415,608 A 5/1995 Bode et al.
5,476,103 A * 12/1995 Nahsner ..... 600/595
5,507,708 A * 4/1996 Ma ..... 482/52
5,584,779 A * 12/1996 Knecht et al. ..... 482/8
5,597,376 A 1/1997 Bode et al.
5,833,557 A * 11/1998 Cole ..... 473/472
5,833,576 A * 11/1998 Henmi ..... 482/52
5,931,766 A 8/1999 Cooper
6,227,968 B1 * 5/2001 Suzuki et al. ..... 463/7
6,228,005 B1 * 5/2001 Gray ..... 482/23
6,336,891 B1 * 1/2002 Fedrigon et al. ..... 482/8
6,409,599 B1 * 6/2002 Sprout et al. ..... 463/31
6,410,835 B2 * 6/2002 Suzuki et al. ..... 84/464 R
6,450,886 B1 * 9/2002 Oishi et al. ..... 463/36
6,645,067 B1 * 11/2003 Okita et al. ..... 463/7

(Continued)

*Primary Examiner* — Loan Thanh
*Assistant Examiner* — Daniel F Roland
(74) *Attorney, Agent, or Firm* — The Webb Law Firm, PC

(57) ABSTRACT

The present invention is a plyometric jumping exercise game apparatus and method of use. The apparatus is adapted to provide a challenging game for a participant that causes the participant to jump from a first location to a second location in response to predetermined signals. The apparatus provides for timed score keeping and may be used by a single individual or by groups of individuals in competitive play. While use of the apparatus is entertaining for the participant, it also improves the participant's jumping ability, speed, reaction time, and physical endurance.

13 Claims, 2 Drawing Sheets

U.S. PATENT DOCUMENTS

| | | | | |
|---|---|---|---|---|
| 6,656,096 | B2 | 12/2003 | Sela | |
| 6,682,444 | B2 * | 1/2004 | Gordon | 473/415 |
| 6,688,595 | B2 | 2/2004 | Hajianpour | |
| 6,739,974 | B2 * | 5/2004 | Kanno et al. | 463/36 |
| 6,758,753 | B1 * | 7/2004 | Nagata et al. | 463/36 |
| 6,905,413 | B1 * | 6/2005 | Terao et al. | 463/40 |
| 7,261,299 | B1 | 8/2007 | Chiu | |
| 7,614,958 | B2 * | 11/2009 | Weston et al. | 473/62 |
| 7,850,514 | B2 * | 12/2010 | Weber | 463/2 |
| 7,854,686 | B2 * | 12/2010 | Mar et al. | 482/8 |
| 2001/0019988 | A1 | 9/2001 | Sela | |
| 2001/0021665 | A1 * | 9/2001 | Gouji et al. | 463/7 |
| 2002/0055383 | A1 * | 5/2002 | Onda et al. | 463/36 |
| 2002/0084583 | A1 | 7/2002 | Hajianpour | |
| 2003/0216228 | A1 | 11/2003 | Rast | |
| 2004/0043367 | A1 * | 3/2004 | Chou | 434/250 |
| 2005/0192075 | A1 * | 9/2005 | Hiranoya | 463/16 |
| 2006/0035774 | A1 | 2/2006 | Marks | |
| 2010/0022287 | A1 * | 1/2010 | Chiwata | 463/7 |

* cited by examiner

PLYOMETRIC JUMPING EXERCISE GAME APPARATUS AND METHOD OF USE

CROSS-REFERENCE TO RELATED APPLICATIONS

The present application claims priority to U.S. Provisional Patent Application No. 61/104,759, filed Oct. 12, 2008, the contents of which is incorporated herein by reference.

BACKGROUND OF THE INVENTION

Field of the Invention

The present invention relates to exercise games and especially exercise games requiring a participant to jump while improving the participant's speed, agility, and jumping height.

Exercise equipment is well-known in the art and is widely used for improving or maintaining a participant's health and fitness. However, often such equipment is used regularly for a brief period after purchase, only to sit idly thereafter. Further, games and devices for increasing speed and agility are well-known in the art and are often used in competitive play. For example, plyometric boxes constructed of plastic or foam are commonly used to increase the speed and agility of the user by, for example, jumping from a standing position onto the box. However, know methods and devices do not provide for a means of measuring the user's improvement in speed and agility in an entertaining and efficient manner.

SUMMARY OF THE INVENTION

The present invention is a plyometric jumping exercise game apparatus and method of use. The apparatus is adapted to provide a challenging game for a participant that causes the participant to jump from a first location to a second location in response to predetermined signals. Unlike other known devices, the apparatus of the present invention provides for timed score keeping by use of a load sensor and may be used by a single individual or by groups of individuals in competitive play. While use of the apparatus is entertaining for the participant, it also improves the participant's jumping ability, speed, reaction time, and physical endurance.

In one embodiment of the present invention, a plyometric jumping exercise game apparatus comprises a base platform, a plurality of target platforms of various heights, a plurality of load sensors, a plurality of lights, at least one scoreboard, and at least one central processing unit (CPU). The target platforms are connected to the base platform. At least one light is mounted to the base platform, and at least one light is mounted adjacent to each target platform. The scoreboard is also mounted to the base platform, and the CPU is mounted within the scoreboard. Furthermore, the CPU is electrically connected to the sensors, lights, and scoreboard. Furthermore, the apparatus may include a speaker which is electrically connected to the CPU. The target platforms may be connected to a periphery of the base platform. The target platforms may be comprised of metal or steel. The apparatus may also comprise a plurality of pedestals, wherein each target platform is positioned on a top portion of a respective pedestal. In a particular embodiment, the pedestals comprise cylindrical columns of various heights. Alternatively, the pedestals may comprise a box-type form. The lights mounted adjacent to each target platform may be mounted to either the target platform or to a periphery of the base platform. Lastly, the apparatus may further comprise safety handrails associated with each target platform.

The apparatus may be operated by illuminating the light mounted to the base platform, and, then, extinguishing that light once a user has been positioned on the base platform. A first light mounted adjacent to a first target platform is illuminated, and, then, the first light is extinguished when the user has jumped from the base platform to the first target platform. A score is assigned to the user's jump from the base platform to the first target platform, and the score is displayed on the scoreboard. The light on the base platform is illuminated again, and, then, the light on base platform is extinguished once the user has jumped from the first target platform back onto the base platform. Additionally, a second light mounted adjacent to a second target platform may be illuminated, wherein the described process is repeated. A second score is assigned associated with a user's jump onto the second target platform. The second score is added to the first score, and a total score is then displayed on the scoreboard. In an additional embodiment, the score associated with the user's jump is based on an amount of time taken for the user to jump from the base platform to the target platform.

A method of playing a plyometric game comprises providing the plyometric jumping exercise game apparatus, and jumping from the base platform to a first target platform when a first light associated with the first target platform is illuminated. The method may further comprise the steps of jumping from the first target platform to the base platform upon illumination of the at least one light mounted to the base platform and jumping to a second target platform associated with a second light upon illumination of the second light.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which:

FIG. 2 is top view of a first embodiment of a plyometric jumping exercise game apparatus, and;

FIG. 5 is a side view of an embodiment of a plyometric jumping exercise game comprising a stand for a scoreboard.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are included to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 1:
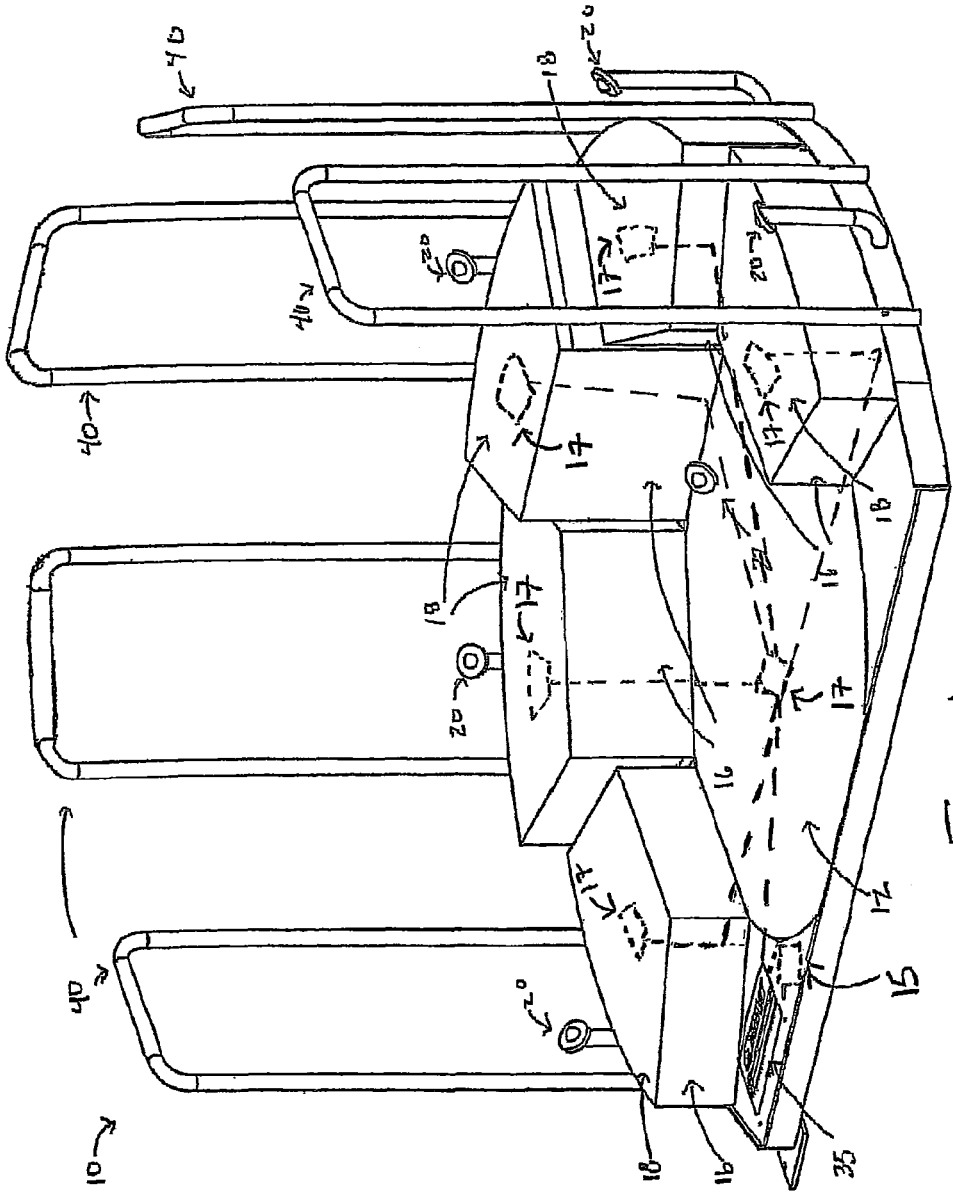
FIG. 1 is an isometric view of a first embodiment of a plyometric jumping exercise game apparatus.

Referring now to FIG. 1, a first embodiment of the invention is a plyometric jumping exercise game apparatus 10. The apparatus 10 comprises a base platform 12, a base light 22, a plurality of pedestals 16 of various heights, a plurality of target platforms 18, a plurality of load sensors 17, a plurality of target lights 20, preferably a plurality of speakers 15, a stand 30, a scoreboard 35, and a central processing unit (CPU).

The base platform 12 defines a generally large flat platform and is preferably of a large enough size that a person standing on the base platform 12 may take at least one step from a standing position and still remain on the base platform 12. The base platform 12 is preferably of rugged construction to withstand the loading and abuse of a person jumping on the base platform 12 without damage to or failure of the base platform 12, while a top surface of the platform 12 is pliable enough to absorb the energy of a person jumping on the base platform 12.

The base light 22 defines a lightable light that is readily commercially available such as an incandescent or light emitting diode (LED) type of light.

The target platforms 18 are generally small flat platforms and are preferably of a size that a person may stand comfortably on the target. The target platforms 18 are preferably of rugged construction to withstand the loading and abuse of a person jumping on the target platform without damage to or failure of the target platform 18, while a top surface of the target platform 18 is pliable enough to absorb the energy of a person jumping on the target platform 18. The general shape of the pedestals 16 and the platforms 18 may take the form of plyometric boxes.

The target lights 20 define lightable lights that are readily commercially available such as incandescent or light emitting diode (LED) type of lights.

Optionally, the speakers define common speakers that are readily commercially available and that emit a sound such as a simulated or recorded voice sound in response to predetermined electrical signals.

The scoreboard 35 defines a scoreboard preferably having an LED, LCD, or other like display system for displaying at least a score and an elapsed time. The scoreboard is further constructed so as to provide for a CPU retention cavity.

The CPU (not shown) is preferably adapted to monitor and respond to sensory input and to process game functions while keeping a game score and an elapsed time. The CPU may comprise a commercially available CPU.

The apparatus 10 is assembled such that the base light 22 is connected to the base platform 12 and such that the base light 22 is visible to an apparatus user when the user is standing on the base platform 12 or a target platform 18. The plurality of pedestals 16 are connected to a portion of the periphery of the base platform 12 and are preferably substantially equal widths. Each of the pedestals 16 includes a target platform 18 positioned on a top portion of the pedestal. The base platform 12 and each target platform 18 includes a load sensor 17 mounted to the respective platforms 18 such that the load sensor 17 is capable of sensing a load that is applied to the platform 18. Preferably, the load sensor 17 is embedded within the platform 18 approximately one inch below a top surface of the platform 18. Further, a target light 20 corresponds to each respective target platform 18. The target light 20 is connected to either the periphery of the base platform 12 or the pedestal 16 such that the target light 20 is visible to an apparatus user when the user is standing on the base platform 12 or the target platform 18 and such that the target light 20 is associated with a single target platform 18. At least one speaker 15 is mounted to the base platform 12.

In an alternative embodiment, as shown in FIG. 5, the apparatus 10 may comprise a stand 30 for supporting the scoreboard 35 and CPU, as shown. The stand 30 may define an elongated formed tube preferably of metal construction, such as steel, and capable of supporting the handling loads and the weight of the scoreboard 35 and CPU. The stand 30 is mounted to the base platform 12 on a lower end of the stand 30 and the scoreboard 35 is mounted to the stand 30 on an upper end of the stand 30 such that scoreboard 35 is visible to an apparatus user when the user is standing on the base platform 12 or the target platform 18. The CPU is mounted within the scoreboard and is electrically connected to the base light, target lights, speakers, sensors, and scoreboard. Preferably, the load sensors 17 may be operably coupled to control circuitry, schematically shown in FIG. 1, to facilitate recognition of the load of a user jumping on the target platform 18 (e.g., the load sensors 17 are operatively coupled to signal the control circuitry when a user has jumped on a target platform 18). The load sensors may take the form of a vibrational transducer. The control circuitry is also coupled to the CPU, wherein the CPU keeps score and controls the other components of the apparatus 10 based upon the load recognized by the load sensors.

In practice, a user stands on the base platform 12 and initiates the game. The apparatus illuminates a first target light 20 and the user jumps to the target platform associated with the illuminated first target light 20. The apparatus senses the load of the user jumping on the target platform 18 associated with the illuminated first light and then extinguishes the illuminated first target light 20 and illuminates the base light 22. Upon the extinguishment of the first illuminated target light 20 and the illumination of the base light 22, the user jumps from the first target platform 18 back to the base platform 12. The apparatus 10 senses the load of the user jumping on the base platform 12 and then extinguishes the illuminated base light 22 and illuminates a second target light 20. The user then jumps from the base platform 12 to the second target platform 18 associated with the second illuminated target light 20. A score is earned by jumping on an indicated target platform 18 within a predetermined or preferably user adjustable elapsed time. For example, if a user jumps on the indicated target platform 18 within one second, the user is awarded five points, if the user jumps on the indicated platform within two seconds, the user is awarded four points, if the user jumps on the indicated platform within three seconds, the user is awarded three points, and so on. The described process is repeated for a random or predetermined set and order of target platforms 18 for a predetermined time, the predetermined time optionally being set by the user prior to use, or until a predetermined score is achieved. The apparatus may also provide audible indications for a user to jump and, in addition to a score and elapsed time being displayed on the scoreboard 35, the apparatus 10 may also audibly provide a running score, a completed score, and an elapsed time value.

Figure 3:
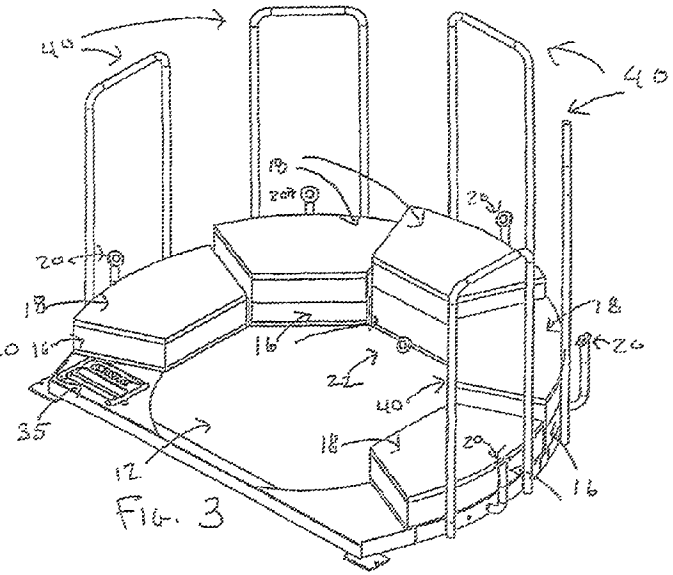
FIG. 3 is an additional isometric view of a plyometric jumping exercise game apparatus.
Figure 6:
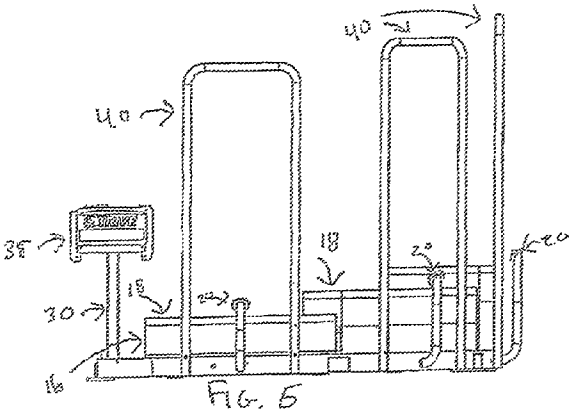
Figure 7:
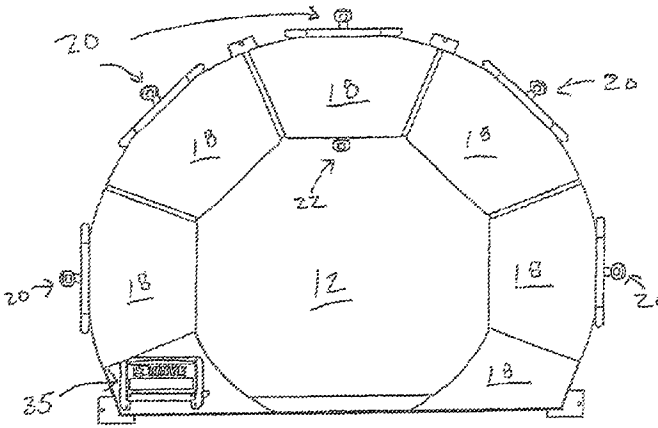
Figure 4:
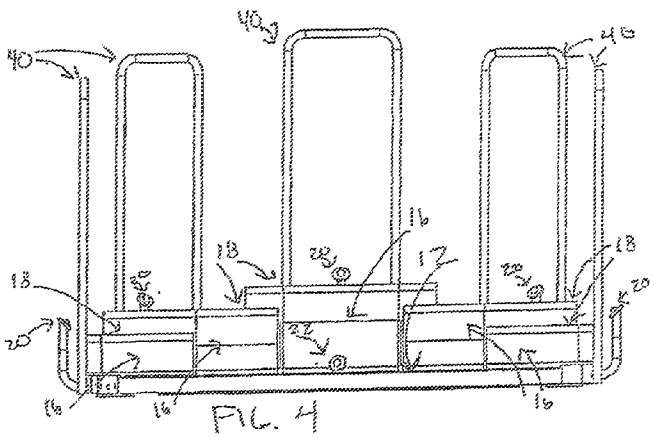
FIG. 4 is a front view of a plyometric jumping exercise game.

Optionally, as best illustrated in FIGS. 3-5, the apparatus 10 may comprise a plurality of safety handrails 40. The safety handrails 40 protect a user from over jumping a target platform 18 or losing balance after jumping onto a target platform

18. Each safety handrail 40 is associated with a separate target platform 18 and may optionally be attached to a portion of the periphery of the base platform 12, as shown in FIGS. 3-5.

In another embodiment, the pedestals 16 define cylindrical columns of various heights with target platforms 18 attached to a top of the cylindrical columns, unlike the block type target pedestals and platforms illustrated in FIGS. 1-5. The pedestals 16 and target platforms 18 are preferably of rugged construction to withstand the dynamic loading and abuse of a person jumping on the pedestal 16 without damage to or failure of the pedestal 16, while the target platforms 18 comprise a material which is pliable enough to the absorb the energy of the user landing on the pedestal.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A plyometric jumping exercise game apparatus comprising:

a base platform;

a plurality of target platforms of various heights;

a plurality of load sensors, a separate load sensor of the plurality of load sensors being associated with each of the base platform and platforms of the plurality of target platforms, wherein each of the target platforms and base platform are capable of separately receiving and sensing an applied load;

a plurality of lights;

at least one scoreboard; and at least one CPU, wherein each of said target platforms are directly connected to and extend from a top surface of said base platform to a height above the base platform, and wherein at least one light is mounted to said base platform and at least one light is mounted adjacent to each target platform of said plurality of target platforms, and wherein said scoreboard is mounted to said base platform, and wherein said CPU is mounted within said scoreboard, said CPU being electrically connected to said sensors, said lights, and said at least one scoreboard.

2. The apparatus of claim 1, further comprising at least one speaker, wherein said speaker is electrically connected to said CPU.

3. The apparatus of claim 1, wherein each of the target platforms extend from a periphery of the base platform.

4. The apparatus of claim 1, further comprising a plurality of pedestals, wherein each target platform of said plurality of target platforms is positioned on a top portion of a respective pedestal of said plurality of pedestals.

5. The apparatus of claim 4, wherein the pedestals comprise cylindrical columns of various heights.

6. The apparatus of claim 4, wherein the pedestals comprise a box-type form.

7. The apparatus of claim 1, wherein the at least one light mounted adjacent to each target platform is mounted to the target platform.

8. The apparatus of claim 1, wherein the at least one light mounted adjacent to each target platform is mounted to a periphery of the base platform.

9. The apparatus of claim 1, further comprising safety handrails associated with each target platform of said plurality of target platforms.

10. The apparatus of claim 1, wherein the target platforms comprise a material of rugged construction to withstand loading and abuse of a person jumping on the base platform.

11. The apparatus of claim 10, wherein a top surface of each target platform of said plurality of target platforms comprises a material pliable enough to absorb energy of a user jumping on the target platform.

12. The apparatus of claim 1, wherein, in use, a first target light of the plurality of lights, mounted adjacent to a first target platform of the plurality of target platforms, is illuminated until a load is sensed by a first load sensor associated with the first target platform, wherein the first target light is extinguished and the light mounted to the base platform is illuminated until a load is sensed by the load sensor associated with the base platform.

13. The apparatus of claim 12, wherein, after a load is sensed by the load sensor associated with the base platform, the light mounted to the base platform is extinguished and a second target light of the plurality of lights, mounted adjacent to a second target platform of the plurality of target platforms, is illuminated until a load is sensed by a second load sensor associated with the first target platform.

* * * * *